United States Patent [19]

Rollwitz

[11] Patent Number: 4,467,871

[45] Date of Patent: Aug. 28, 1984

[54] ROD STAND

[76] Inventor: Curtis W. Rollwitz, 2034 Tech Dr., Levelland, Tex. 79336

[21] Appl. No.: 483,646

[22] Filed: Apr. 11, 1983

[51] Int. Cl.[3] ..... E21B 19/00

[52] U.S. Cl. ..... 166/369; 285/419

[58] Field of Search ..... 166/369, 382, 379, 380, 166/77.5, 79, 85; 285/419, 373; 277/5, 7; 211/605

[56] References Cited

U.S. PATENT DOCUMENTS

| | | | |
|---|---|---|---|
| 2,880,761 | 4/1959 | Peter | 285/419 X |
| 3,051,237 | 8/1962 | Liles, Jr. et al. | 166/369 X |
| 4,386,919 | 6/1983 | Kadono | 285/419 X |

*Primary Examiner*—Ernest R. Purser
*Assistant Examiner*—Thuy M. Bui
*Attorney, Agent, or Firm*—Wendell Coffee

[57] ABSTRACT

A pump jack of a well is stopped when the polished rod clamp is elevated above the wellhead. A rod stand is secured around the polished rod encircling it. The rod stand is between the clamp and the wellhead top. The pump jack is lowered and then stopped when the clamp rests on the rod stand. After the well is serviced, the pump jack is raised and then stopped when the clamp is elevated above the rod stand. The rod stand is removed from the polished rod and the pump jack is started for normal operation. The rod stand is in the form of a pipe with a thick washer on each end, which has been split and hinged together.

5 Claims, 4 Drawing Figures

ROD STAND

BACKGROUND OF THE INVENTION (1) Field of the Invention

This invention relates to wells and more particularly to tools for supporting sucker rods while servicing the pump jack and well.

(2) Description of the Prior Art

Wells, particularly oil wells, often have a wellhead which projects above the ground with a wellhead top. Typically a stuffing box is at the wellhead top. A sucker rod extends through the stuffing box and is reciprocated by a pump jack. The top portion of the sucker rod, the portion which goes through the stuffing box, is called a polish rod. It is necessary to service and adjust the pump jack and sucker rod.

Before my invention, when it was necessary to service the pump jack or adjust the position of the sucker rods in the well, an open spacer, or u-shaped device or "suitcase" was placed on the wellhead top. Then a clamp on the polished rod was lowered onto the spacer.

Because the spacer often became dislodged with the movement of the polished rod, it was frequently difficult, if not impossible, for one person to service the well alone. The prior art device and its use resulted in a hazardous situation. I.e. one person had to hold the spacer in place while another person operated the pump jack to lower the clamp onto the spacer and thereby support the sucker rods to allow adjustments and servicing.

Prior to filing this application, a search was made in the United States Patent and Trademark Office. That search developed the following United States patents:

| | |
|---|---|
| CRONIN | 306,588 |
| HATCH | 1,343,821 |
| REARWIN | 2,317,404 |
| CHAMBLEE | 3,330,354 |
| TIMMONS | 3,422,524 |
| GANGL ET AL | 3,527,295 |
| HUTCHISON | 3,593,800 |
| WHEELER | 3,739,434 |

These patents are considered pertinent because the applicant believes the Examiner would consider anything revealed by the search to be relevant and pertinent to the examination of this application.

SUMMARY OF THE INVENTION

New Function and Surprising Results

I have invented a rod stand that accomplishes the unusual and surprising results of permitting a single individual to support a sucker rod incident to servicing a well at a convenient position with my novel combination of steel plates, hinges, steel pipes etc.

The method of operation of my invention is less complicated and more efficient than the prior art methods.

An improved rod stand according to my invention is formed by two supports for encircling or girdling the polished rod. The supports are spaced apart by spacer structure therebetween. The spacing of the girdle may be that required to place the connection of the pump jack to the polished rod at a convenient height. The supports or girdles are positioned between a clamp on the polished rod and the wellhead top so that when the clamp is lowered, thereby sliding the polished rod through the rod stand, the clamp will rest on the top girdle and the bottom girdle will rest on the wellhead top, thereby supporting the polished rod and sucker rods therebelow from the wellhead top and relieving the pump jack of the weight of the sucker rods.

The girdles are typically steel washers or plates with apertures therein that are attached to the spacer structure. The plates are split through the apertures to provide two halves that may be hinged or fastened together to allow them to be positioned around the polished rod thereby capturing or encircling it.

Prior art devices were either slotted or U-shaped pieces that became easily dislodged. My invention solves the problems inherent with the U-shaped or slotted plates in that it encircles the polished rod and cannot be dislodged therefrom.

My invention does away with such cumbersome and inefficient methods. A single person may now easily support a sucker rod from the wellhead top and position the connection of the pump jack to the polished rod at a convenient height for work.

Therefore, it may be seen that the function of the total combination far exceeds the sum of the functions of the individual elements, such as plates, hinges, handles, etc.

Objects of this invention

An object of this invention is to support sucker rods from wellhead tops while servicing the pump jack or the well.

Further objects are to achieve the above with a device that is sturdy, compact, durable, lightweight, simple, safe, efficient, versatile, ecologically compatible, energy conserving, and reliable, yet inexpensive and easy to manufacture, install, operate and maintain.

Other objects are to achieve the above with a method that is versatile, ecologically compatible, energy conserving, rapid, efficient, and inexpensive, and does not require skilled people to install, operate, and maintain.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENT

Figure 1:
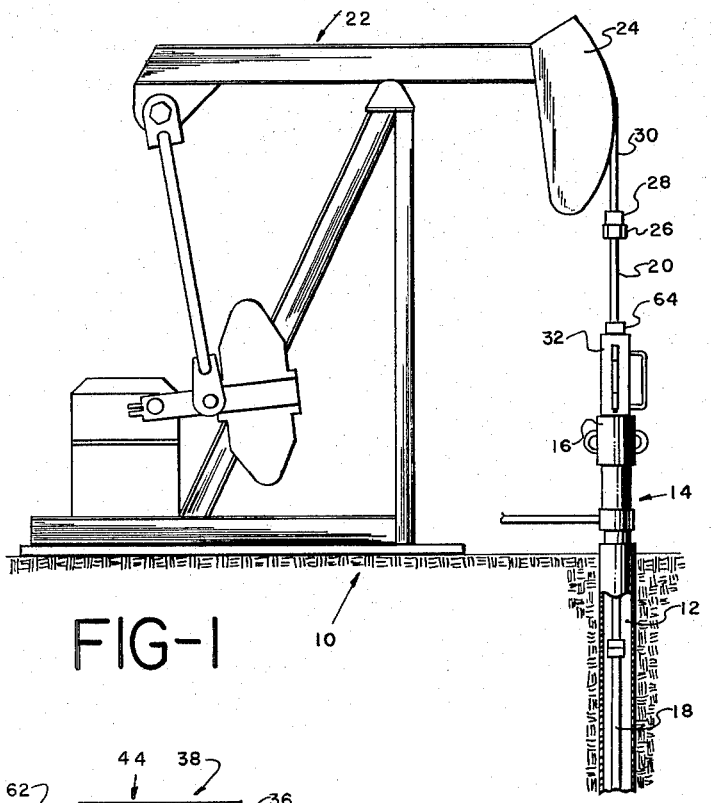
FIG. 1 is a somewhat schematic side elevational view of an oil well with a rod stand, according to my invention, mounted thereon.

Referring to FIG. 1, well 10 has bore 12 extending below a ground surface and associated with wellhead 14 above the ground surface. Wellhead top 16 in the form of a stuffing box is attached to the wellhead. Sucker rod 18 depends into the bore 12. Polished rod 20 is the top of the sucker rod 18. The term polish rod will include liner, if such is used. The sucker rod 18 is connected to pump jack 22. The pump jack 22 provides means for reciprocating the polished rod and sucker rod up and down within the bore 12 through the stuffing box of the wellhead 14.

Although this embodiment of my invention is shown in connection with an oil well, it will be understood that my invention is applicable to any well employing sucker rods and reciprocating action to pump a fluid from below ground to the ground surface.

As used herein, a polished rod is the upper most portion of the sucker rod assembly that extends through the wellhead and wellhead top to which the pump jack is connected. For example, on the oil well, the polished rod extends through the wellhead and stuffing box and is secured to the pump jack by cables extending therefrom from a horsehead thereof.

As used herein, a pump jack includes any means for reciprocating the sucker rod within the bore, including, but not limited to, a horsehead and pump jack as commonly used with oil wells.

Figure 2:
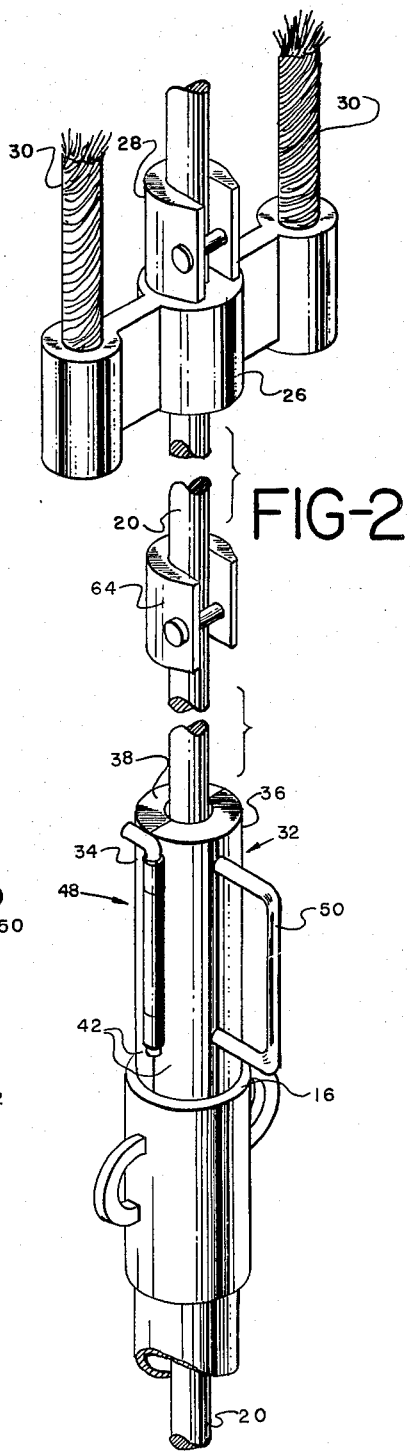
FIG. 2 is a perspective view of the rod on the polish rod.
Figure 3:
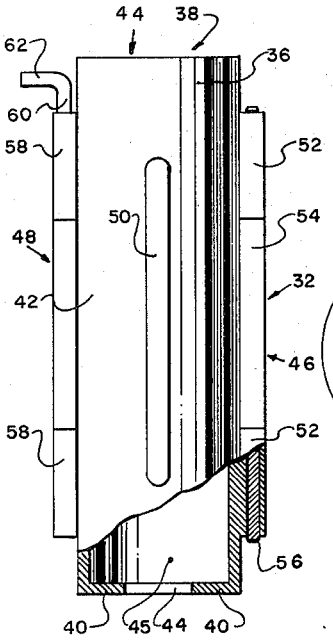
FIG. 3 is a side view of the rod stand partially broken away.
Figure 4:
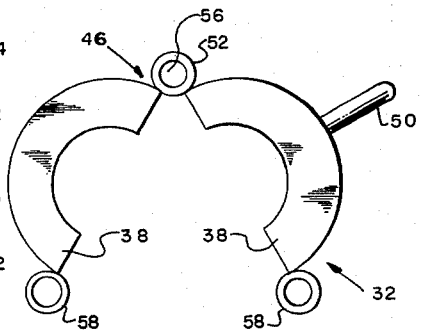
FIG. 4 is a top view of the rod stand.

Referring to FIG. 2, the horsehead 24 of the pump jack is commonly connected to the polished rod by cables connected to the horsehead and to carrier bar 26. The polished rod is supported by the carrier bar by carrier clamp 28 above the bar 26. The carrier clamp 28 carrier bar, and cables 30 form a means for connecting the pump jack to the polished rod 20.

Rod stand 32 includes stand sections 34 and 36. Each stand section 34 or 36 include upper piece 38, lower piece 40, and spacer structure 42. I prefer to form the upper and lower pieces 38 and 40 from steel plates. The spacer structure is preferably formed of steel tubing or pipe divided lengthwise. It may be seen that when the stand sections 34 and 36 are closed, a pipe is formed with steel plates at each end. The upper pieces 38 form an upper washer shaped girdle or support and the lower pieces 40 form a lower washer shaped girdle or support spaced apart and connected by the spacer structure 42. The girdles have apertures 44 therein. The apertures are of greater diameter than the polished rod. I prefer to round the edges of the apertures and to provide a smooth surface to avoid damaging the polished rod. The spacer structure 42 surrounds an unobstructed opening or cavity or passageway 45 extending between the apertures 44.

Hinge 46 forms a fastener of one side of the stand sections 34 and 36. Clasp 48 forms a fastener on the unhinged side of the sections. Handle 50 is connected to one of the stand section for a person to conveniently carry the rod stand, or hold it in place while operating the clasp.

Hinge 46 includes two tubes 52 welded to stand section 36 and one tube 54 attached, as by welding, to stand section 34. The tubes 52 and 54 are coaxial and parallel to the axis of the pipe formed by the closed stand sections 34 and 36. Pin 56 is within the tubes 52 and 54 to form the hinge. Likewise, the clasp 48 include three tubes 58 welded to the stand sections in a similar manner. Clasp pin 60 extends through the tubes to fasten the stand sections together forming the closed stand or pipe. Clasp pin 60 is shown with bent hand grip 62 so it may be readily removed and inserted. Those having ordinary mechanical skill will understand that the hinge pin 56 could likewise be removable by a similar hand grip so that either side could be opened or either side could be hinged.

Having described the rod stand 32 fully, the method of operation may be seen to occur as follows. The person servicing the well operates the pump jack if it is not already operating. When lower clamp 64 is substantially elevated above the wellhead top 16 so that the rod stand 32 may be placed therebetween, the pump jack is stopped. The rod stand is then opened, and positioned with the rod 20 within the apertures of one of the stand sections. The other section is then moved about the hinge 46 until the rod stand encircles the polish rod 20. The clasp 48 is then engaged, thereby capturing or encircling the polished rod within the rodstand while permitting free slidable movement of the rod stand lengthwise along the polished rod.

The person servicing the well then operates the pump jack until the rod stand or lower girdle or lower pieces 40 rest on the wellhead top 16. The lower clamp 64 will rest on the rod stand or upper girdle or upper pieces 38. In this position, the weight of the sucker rods is supported by the rod stand and by the wellhead. Having thus released the weight of the sucker rods from the carrier bar, cables, carrier clamp, and pump jack, servicing of the pump jack or adjustment of the sucker rod and polish rod may be accomplished.

After servicing is completed, the pump jack is then operated. When the lower clamp 64 is elevated above the rod stand 32 upper girdle or upper pieces 38 the pump jack is stopped. The person servicing the well grasps the handle, and disengages the clasp 48. The rod stand sections are opened and the rod stand 32 is then removed. The pump jack is then started for normal well operation.

Anyone skilled in the art will know that the length the spacer structure is dependent upon the spacing between the carrier bar and the wellhead top.

The embodiment shown and described above is only exemplary. I do not claim to have invented all the parts, elements or steps described. Various modifications can be made in the construction, material, arrangement, and operation, and still be within the scope of my invention.

The limits of the invention and the bounds of the patent protection are measured by and defined in the following claims. The restrictive description and drawing of the specific example above do not point out what an infringement of this patent would be, but are to enable the reader to make and use the invention.

As an aid to correlating the terms of the claims to the exemplary drawing, the following catalog of elements is provided:

| | |
|---|---|
| 10 well | 40 lower pieces |
| 12 bore | 42 spacer structure |
| 14 wellhead | 44 aperture |
| 16 wellhead top | 45 passageway |
| 18 sucker rod | 46 hinge |
| 20 polished rod | 48 clasp |
| 22 pump jack | 50 handle |
| 24 horsehead | 52 tubes |
| 26 carrier bar | 54 tube |
| 28 carrier clamp | 56 hinge pin |
| 30 cables | 58 tubes |
| 32 rod stand | 60 clasp pin |
| 34 stand section | 62 hand grip |
| 36 stand section | 64 lower clamp |
| 38 upper pieces | |

Subject Matter Claimed For Protection:

I claim as my invention:

1. The process involving a well having
a. a bore extending below ground surface,
b. a wellhead above ground surface associated with the bore,
c. a top on the wellhead,
d. at least one sucker rod depended through the wellhead top into the bore,
e. a polished rod at a top end of the sucker rod,
f. a pump jack connected to the polished rod for reciprocating the polished rod and the sucker rod lengthwise through the wellhead top within the bore, and g. a clamp affixed to the polished rod above the wellhead top;

the process including h. operating the pump jack, i. stopping the pump jack when the clamp on the polished rod is substantially elevated above the wellhead top, then j. positioning spaced apart upper and lower supports lengthwise along the polished rod between the clamp and the wellhead top, k. sliding the polished rod lengthwise through the spaced apart supports while l. operating the pump jack, m. stopping the pump jack when the lower support rests on the wellhead top and the clamp rests on the upper support, then n. servicing the well, then o. operating the pump jack, p. stopping the pump jack when the clamp on the polished rod is elevated above the upper support, then q. removing the spaced apart supports from the polished rod, then r. operating the pump jack, wherein the improvement comprises in combination with the above steps:

s. encircling the polish rod with the supports, thus t. forming a girdle around the polish rod, and u. fastening the girdle in the encircled position around the polish rod.

2. On a well having a. a bore extending below ground surface, b. a wellhead above ground surface associated with the bore, c. a top on the wellhead, d. at least one sucker rod depended through the wellhead top into the bore, e. a polished rod at a top end of the sucker rod, f. a pump jack connected to the polished rod for reciprocating the polished rod and the sucker rod lengthwise through the wellhead top within the bore, and g. a clamp affixed to the polished rod;

the improved tool comprises in combination with the above:

h. a rod stand having (i) an upper girdle connected to and spaced away from (ii) a lower girdle by (iii) spacer structure, j. the girdles having apertures therein, k. the spacer structure having a passageway therein extending from aperture to aperture, l. the apertures and passageway being sized to slidably receive the polished rod lengthwise therethrough, m. capture means on the rod stand for encircling the polished rod and maintaining the polished rod within the aperture and the passageway without restricting lengthwise slidable movement of the polished rod therethrough, n. said capture means being disengagable to open the girdles and remove the rod stand from the polished rod, and o. said rod stand resting on said wellhead top.

3. On a well having a. a bore extending below ground surface, b. a wellhead above ground surface associated with the bore, c. a top on the wellhead, d. at least one sucker rod depended through the wellhead top into the bore, e. a polished rod at a top end of the sucker rod, f. a pump jack connected to the polished rod for reciprocating the polished rod and the sucker rod lengthwise through the wellhead top within the bore, and g. a clamp affixed to the polished rod;

the improved tool comprises in combination with the above:

h. a rod stand having two stand sections, j. each stand section having (i) an upper piece connected to and spaced apart from (ii) a lower piece by (iii) spacer structure, k. a hinge on the stand sections, l. a fastener on the stand sections for fastening the hinged sections together to form the rod stand, m. the fastener being disengagable to open the stand sections and remove the rod stand from the polished rod, n. said upper pieces, lower pieces and spacer structure being shaped such that when the stand sections are fastened to form the rod stand, (i) the upper pieces form an upper girdle with an upper aperture therein, (ii) the lower pieces form a lower girdle with a lower aperture therein, (iii) the spacer structure defines a passageway extending from upper aperture to lower aperture, (iv) the apertures and passageway being of greater diameter than the polished rod such that the polished rod is lengthwise slidable therethrough, (v) the upper and lower girdles encircle the polished rod, and (vi) the rod stand being slidable lengthwise along the polished rod and resting on, said wellhead top.

4. The invention as defined in claim 3 including all of the limitations a. through n. with the addition of the following limitations:

o. said upper and lower girdles being formed by (i) steel plates with apertures therein, with (ii) the steel plates being divided through the apertures to form said upper and lower pieces, p. said spacer structure being formed by a steel pipe divided lengthwise corresponding to the divisions in the upper and lower girdles.

5. The invention as defined in claim 4 including all of the limitations a. through p. with the addition of the following limitation:

q. a handle on one stand section.

* * * * *